US009834898B2

(12) United States Patent
Chen et al.

(10) Patent No.: US 9,834,898 B2
(45) Date of Patent: Dec. 5, 2017

(54) DEBRIS FLOW DRAINAGE CHANNEL WITH STEP POOL STRUCTURE AND ITS APPLICATIONS

(71) Applicant: INSTITUTE OF MOUNTAIN HAZARDS AND ENVIRONMENT CHINESE ACADEMY OF SCIENCES, Chengdu, Sichuan (CN)

(72) Inventors: Xiaoqing Chen, Sichuan (CN); Fangqiang Wei, Sichuan (CN); Jiangang Chen, Sichuan (CN); Yong You, Sichuan (CN); Tao Wang, Sichuan (CN)

(73) Assignee: INSTITUTE OF MOUNTAIN HAZARDS AND ENVIRONMENT CHINESE ACADEMY OF SCIENCES, Sichuan (CN)

( * ) Notice: Subject to any disclaimer, the term of this patent is extended or adjusted under 35 U.S.C. 154(b) by 0 days.

(21) Appl. No.: 15/025,716

(22) PCT Filed: Jan. 21, 2014

(86) PCT No.: PCT/CN2014/070962
§ 371 (c)(1),
(2) Date: Mar. 29, 2016

(87) PCT Pub. No.: WO2015/100816
PCT Pub. Date: Jul. 9, 2015

(65) Prior Publication Data

US 2016/0312425 A1 Oct. 27, 2016

(30) Foreign Application Priority Data

Jan. 1, 2014 (CN) ..... 2014 1 0001807

(51) Int. Cl.
*E02B 3/10* (2006.01)
*E02B 8/02* (2006.01)
(Continued)

(52) U.S. Cl.
CPC ..... *E02B 3/10* (2013.01); *E01F 7/04* (2013.01); *E02B 5/00* (2013.01); *E02B 5/085* (2013.01); *E02B 8/02* (2013.01)

(58) Field of Classification Search
USPC ..... 405/15, 21, 25, 39, 73, 74, 80, 118, 119; 137/236.1
See application file for complete search history.

(56) References Cited

U.S. PATENT DOCUMENTS 4,655,637 A * 4/1987 Vignocchi ..... E02B 3/12 405/15

FOREIGN PATENT DOCUMENTS

CN 101476305 A 7/2009
CN 101886374 A 11/2010
(Continued)

OTHER PUBLICATIONS http://www.thefreedictionary.com/sill.*
International Search Report dated Oct. 10, 2014 issued in PCT/CN2014/070962.

*Primary Examiner* — Sean Andrish
(74) *Attorney, Agent, or Firm* — Scully Scott Murphy & Presser

(57) ABSTRACT

A debris flow drainage channel is provided. The debris flow drainage channel is applicable to debris flows with large gully bed longitudinal slopes. The debris flow drainage channel has an upstream step section and a downstream step section. The debris flow drainage channel also has a step pool disposed between the upstream step section and the downstream step section. The pool section has a cable net
(Continued)

cage bottom protection, a cable net cage buffer layer and block stones.

6 Claims, 3 Drawing Sheets

(51) Int. Cl.

| | |
|---|---|
| ***E01F 7/04*** | (2006.01) |
| ***E02B 5/00*** | (2006.01) |
| ***E02B 5/08*** | (2006.01) |

(56) References Cited

FOREIGN PATENT DOCUMENTS

| | | | |
|---|---|---|---|
| JP | 03033313 | * | 2/1991 |
| KR | 100673921 B1 | | 1/2007 |
| RU | 2230153 C2 | | 6/2004 |

* cited by examiner

DEBRIS FLOW DRAINAGE CHANNEL WITH STEP POOL STRUCTURE AND ITS APPLICATIONS

FIELD OF THE INVENTION

The present invention relates to a debris flow prevention and control technology, in particular, a debris flow drainage channel with a step pool structure, which is applicable to debris flow gullies with steep gully bed longitudinal slopes.

BACKGROUND OF THE INVENTION

Debris flow disasters are one of the main types of geological disasters experienced worldwide, especially in China. With the economic development of mountainous areas and the development of western China, the demands on debris flow project management are becoming increasingly vigorous. Drainage channels, as one of the main types of debris flow prevention and control projects, are widely applied in debris flow hazard mitigation.

Following the Wenchuan Earthquake, massive collapses and landslides have provided rich solid material sources for the formation of debris flows and a large number of debris flows have been triggered in gullies with steep gully bed slopes of greater than 0.20 and even up to 0.50-0.60. For a debris flow with a large or steep gully bed slope, if the debris flow is discharged using a commonly used fully lined debris flow drainage channel (commonly known as a V-type drainage channel), a situation occurs in which the debris flow intensely abrades the channel bottom because the debris flow velocity in the channel is too high. This greatly reduces the service life of the drainage channel, and the maintenance cost of the operating period is increased. For a debris flow with a steep gully bed slope, if the debris flow is discharged using a ground-sill soft-foundation energy-dissipating debris flow drainage channel (commonly known as a Dongchuan-type drainage channel), when the distance between ground sills is large, a situation occurs in which, because the decrease in altitude of the debris flow is excessive, the debris flow scours the channel bottom by intensely acting on the soil body of the channel bottom. This threatens the safety of the ground sills, thereby resulting in the destruction of the drainage channel. When the distance between ground sills is small, the project investment will be greatly increased, and the safety of the ground sills cannot be ensured. For a debris flow gully with steep slopes, if the debris flows are discharged using a cage-lined debris flow drainage channel (ZL201110380681.5), the prevention and control effect on the low-frequency debris flows are good. However, for high-frequency debris flows, because the abrasion resistance and impact resistance of the wall of the energy dissipation structure are limited, a situation easily occurs in which the wall of the energy dissipation structure is damaged, and thus, the control effect on the debris flows is greatly reduced.

SUMMARY OF THE INVENTION

To overcome the disadvantages of prior methods, i.e., drainage channel bottoms being seriously damaged and being unable to operate normally as well as the high later-stage maintenance costs caused by the intense abrasion and scouring actions of debris flows subject to large gully bed longitudinal slopes and the frequent occurrence of debris flows, the invention provides a debris flow drainage channel with a step pool structure. This structure provides a large degree of safety, lower later-stage maintenance costs, and applicability to debris flow gullies with large gully bed longitudinal slopes.

The technical scheme of the invention, which achieves the above objectives, is described as follows.

The invention provides a debris flow drainage channel with a step pool structure, which consists of a drainage channel bottom and drainage channel side walls arranged on both sides of the drainage channel bottom, wherein the drainage channel bottom consists of multiple fully lined step sections arranged at certain intervals and a pool section filled between the upstream and downstream step sections. The step section consists of an upper indented sill located upstream, a lower indented sill located downstream and a fully lined baseplate connecting the upper indented sill with the lower indented sill. The pool section consists of a cable net cage bottom protection, a cable net cage buffer layer and block stones, wherein the cable net cage buffer layer is arranged above the cable net cage bottom protection and clung to the upper indented sill of the downstream step section. The block stones are arranged in a space defined by the side walls, the cable net cage bottom protection, the lower indented sill of the upstream step section and the cable net cage buffer layer. The cable net cage bottom protection and the cable net cage buffer layer are structurally formed by wrapping block stones in a cable net. Finally, the top surface of the pool section is flush with the highest point of the downstream step section, and the length $L_4$ of the pool section is less than the length $L_1$ of the step section. The main function of the pool section is to dissipate some of the kinetic energy of debris flow movement, regulate the flow velocity of a debris flow and control the scouring of a debris flow body at the bottom of the drainage channel. The pool is the space defined by the side walls, the cable net cage bottom protection, the lower indented sill of the upstream step section and the cable net cage buffer layer. The block stones filling in the pool interact with the debris flow body to dissipate the kinetic energy of the debris flow, thereby achieving the purpose of regulating the flow velocity of the debris flow and controlling the scouring of the debris flow at the channel bottom and the abrasion at the step sections. The cable net cage bottom protection can absorb the impact energy of the debris flow and inhibit the exchange between the debris flow body and the foundation soil body of the channel bottom. In particular, it can control the foundation soil body to participate in debris flow activities, thereby controlling the scouring of the debris flow body at the drainage channel bottom, ensuring normal drainage function and reducing the later-stage maintenance costs. Moreover, the cable net cage buffer layer can produce a buffer effect on the horizontal impact force, borne by the step sections, of the debris flow body.

The length $L_4$ of the pool section is equal to the sum of the laying length $L_2$ of the block stones and the thickness $L_3$ of the cable net cage buffer layer. The length of the cable net cage bottom protection is equal to the length $L_4$ of the pool section. The height $h_2$ of the upper indented sill is equal to the sum of the laying thickness of the block stones and the thickness $h_{13}$ of the cable net cage bottom protection. The height of the cable net cage buffer layer is equal to the laying thickness $h_{12}$ of the block stones. The height $h_1$ of the lower indented sill is equal to the sum of the suspension height $h_{11}$ of the lower indented sill, the laying thickness $h_{12}$ of the block stones, the thickness $h_{13}$ of the cable net cage bottom protection and the extra-buried depth $h_{14}$ (i.e., the buried depth of the lower indented sill below the cable net cage bottom protection) of the lower indented sill. To balance and control costs and construction progress, the suspension height $h_{11}$ of the lower indented sill should be controlled to within a range of less than or equal to 3.0 m; therefore, the length $L_4$ of the pool section is greater than or equal to a quarter of the length $L_1$ of the step section and less than or equal to half of the length $L_1$ of the step section.

The formula of the suspension height $h_{11}$ of the lower indented sill (4) is $h_{11}=(L_1+L_4)\times i_0-L_1\times i_1$, wherein $L_1$ refers to the length of the step section, in m; $L_4$ refers to the length of the pool section, in m; $i_0$ refers to the average gully bed longitudinal slope, generally set as 0.2-0.4; $i_1$ refers to the slope of the step section; and the extra-buried depth $h_{14}$ of the lower indented sill (4) is generally 0.5-1.0 m The laying length $L_2$ (i.e., the pool length of the pool section) of the block stones and the laying thickness $h_{12}$ of the block stones are designed mainly according to the density of the debris flow body; generally, $L_2$ is 2.0-4.0 m, and $h_{12}$ is 1.0-2.0 m. When the density of the debris flow body is large, $L_2$ and $h_{12}$ take on larger values. When the density of the debris flow body is small, $L_2$ and $h_{12}$ take on smaller values. The particle size of the block stones in the pool is not less than 0.2 m and is generally 0.2-0.5 m; the size can be designed according to the density of the debris flow. When the density of the debris flow is large, the particle size of the block stones takes on a larger value. When the density of the debris flow is small, the particle size of the block stones takes on a smaller value.

The thickness $L_3$ of the cable net cage buffer layer is designed mainly according to the density of the debris flow body and is generally 0.5-1.0 m. When the density of the debris flow body is large, $L_3$ takes on a larger value, and when the density of the debris flow body is small, $L_3$ takes on a smaller value. The thickness $h_{13}$ of the cable net cage bottom protection is generally 0.5-1.0 m, the cable diameter of the cable net cage bottom protection and of the cable net cage buffer layer is generally 0.005-0.01 m, and the mesh size of the cable net is generally (0.1 m×0.1 m)–(0.2 m×0.2 m). The cable net cage bottom protection and the cable net cage buffer are designed mainly according to the density of the debris flow body and the suspension height $h_{11}$ of the lower indented sill. When the density of the debris flow body is large and the suspension height $h_{11}$ of the lower indented sill is large, $h_{13}$, the cable diameter and the mesh size of the cable net take on larger values. When the density of the debris flow body is small and the suspension height $h_{11}$ of the lower indented sill is small, $h_{13}$, the cable diameter and the mesh size of the cable net take on smaller values.

The fully lined baseplate is generally a cement-laid stone masonry structure, a concrete structure or a reinforced concrete structure, and the thickness is generally 0.5-1.0 m. The slope $i_1$ of the step section is determined according to the abrasion resistance of materials of the fully lined baseplate and is generally 0.08-0.15. The length $L_1$ of the step section is designed mainly according to the average gully bed longitudinal slope $i_0$ and the materials of the fully lined baseplate and is generally 5.0-20.0 m. When the average gully bed longitudinal slope $i_0$ is large and the abrasion resistance of the materials of the fully lined baseplate is small, the length $L_1$ of the step section takes on a small value. When the average gully bed longitudinal slope $i_0$ is small and the abrasion resistance of the materials of the fully lined baseplate is large, the length $L_1$ of the step section takes on a large value.

To better achieve equilibrium drainage of debris flows under the condition of large gully bed longitudinal slopes and avoid the occurrence of intense scouring and silting, the ratio of the width B of the drainage channel bottom to the depth H (i.e., the effective height of the side wall) of the drainage channel is greater than or equal to 2.0, i.e., $B/H\geq 2.0$. The large gully bed longitudinal slope generally refers to the fact that the average gully bed longitudinal slope $i_0$ is greater than or equal to 0.20, i.e., $i_0\geq 0.20$. The debris flow drainage channel with a step pool structure provided by the invention is particularly suited to the drainage of debris flows with an average gully bed longitudinal slope $i_0$ of 0.2-0.4.

Compared with the state of the art, the debris flow drainage channel with a step pool structure provided by the invention provides the following benefits: by fully utilizing the step pool structure, the debris flow and the block stones interact to dissipate some of the kinetic energy of the movement of the flow and to regulate the flow velocity of the debris flow. In addition, a cable net cage is utilized to absorb the impact energy of the debris flow and inhibit the exchange between the debris flow body and the foundation soil body of the channel bottom, thereby controlling the scouring of the debris flow body at the channel bottom. This ensures normal drainage function and reduces later-stage maintenance costs; moreover, compared with fully lined drainage channels, the debris flow drainage is safer under steep slope conditions, project reliability is greatly improved, and the later-stage maintenance costs are reduced by 50-80%. Compared with ground-sill soft-foundation energy-dissipating debris flow drainage channels, project reliability is greatly improved, and the later-stage maintenance costs are reduced by 30-50%. Compared with cage-lined drainage channels, the later-stage maintenance costs are reduced by 20-40%.

| | |
|---|---|
| 1 side wall | 2 step section |
| 3 upper indented sill | 4 lower indented sill |
| 5 baseplate | 6 cable net cage bottom protection |
| 7 cable net cage buffer layer | 8 block stone |
| $i_1$ slope of step section | $i_0$ average gully bed longitudinal slope |
| $L_1$ length of step section | $L_2$ laying length of block stones |
| $L_3$ thickness of cable net cage buffer layer | |
| $L_4$ length of pool section | |
| $h_1$ height of lower indented sill | $h_{11}$ suspension height |
| $h_{12}$ laying thickness of block stones | |
| $h_{13}$ thickness of cable net cage bottom protection | |
| $h_{14}$ extra-buried depth | $h_2$ height of upper indented sill |
| B width of channel bottom | H depth of drainage channel |

DESCRIPTION OF THE EMBODIMENTS

The following further describes the main embodiments of the invention with reference to the accompanying drawings.

Embodiment 1

Figure 1:
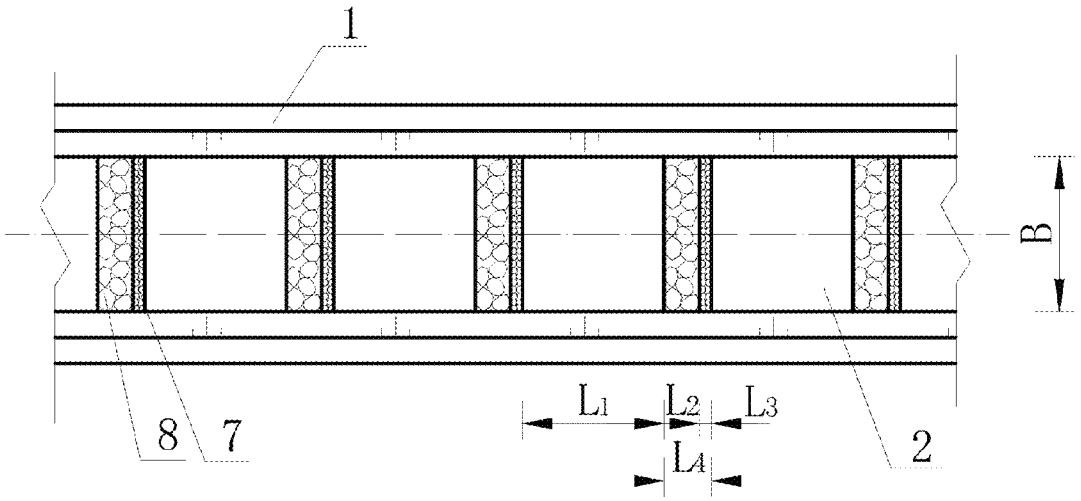
FIG. 1 is a schematic top view of the debris flow drainage channel with a step pool structure.
Figure 2:
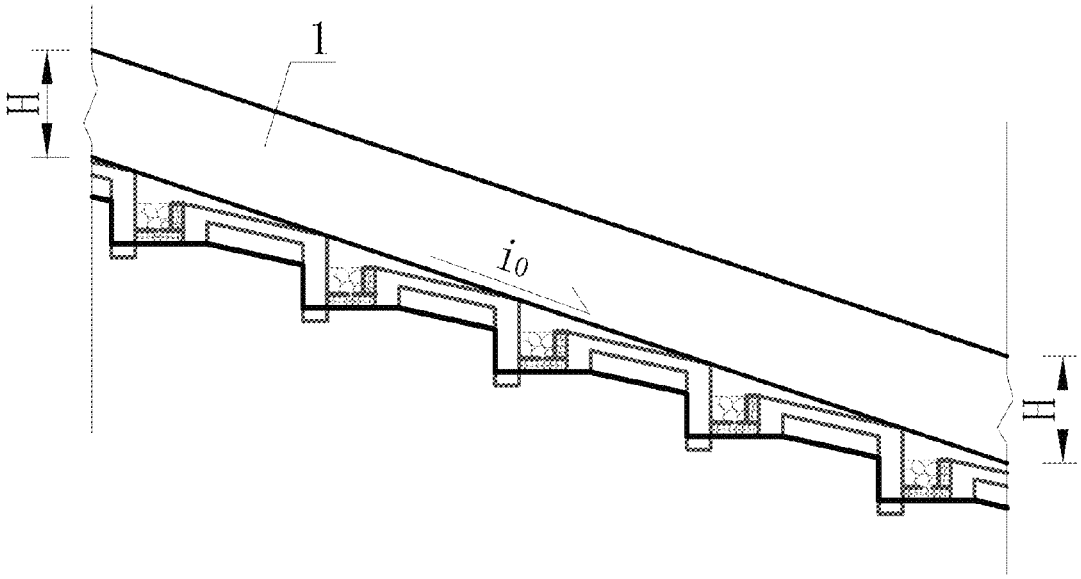
FIG. 2 is a diagrammatic drawing of the longitudinal section of a side face of the debris flow drainage channel with a step pool structure.
Figure 3:
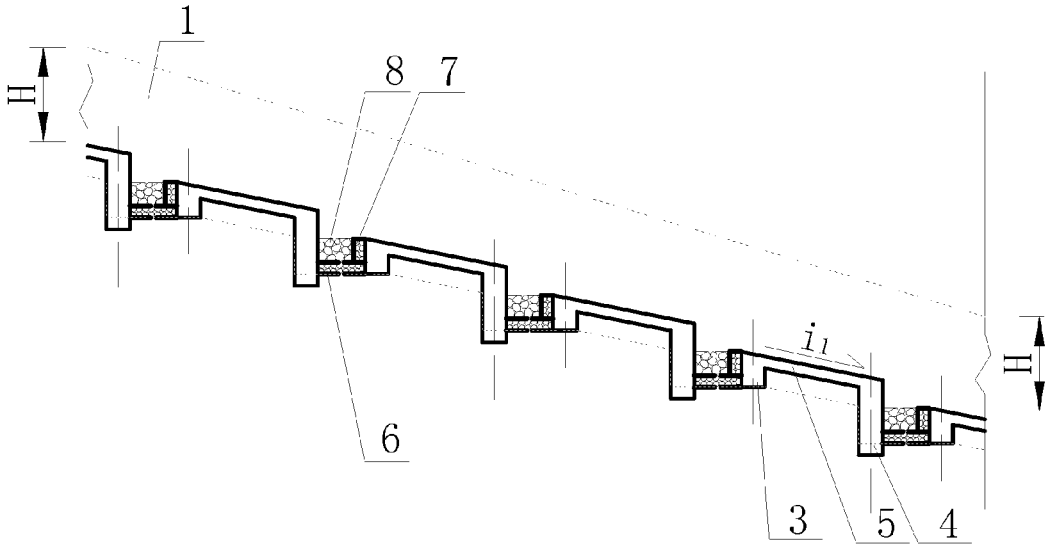
FIG. 3 is a diagrammatic drawing of the longitudinal section of a channel center of the debris flow drainage channel with a step pool structure.
Figure 4:
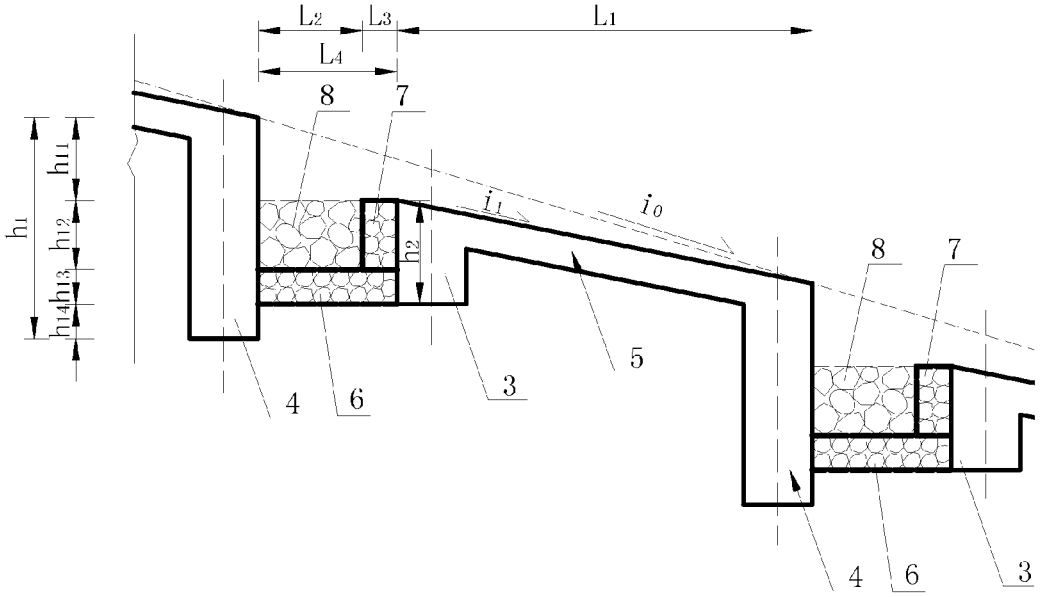
FIG. 4 is an enlarged diagrammatic drawing of the longitudinal section of the channel center of the debris flow drainage channel with a step pool structure.
Figure 5:
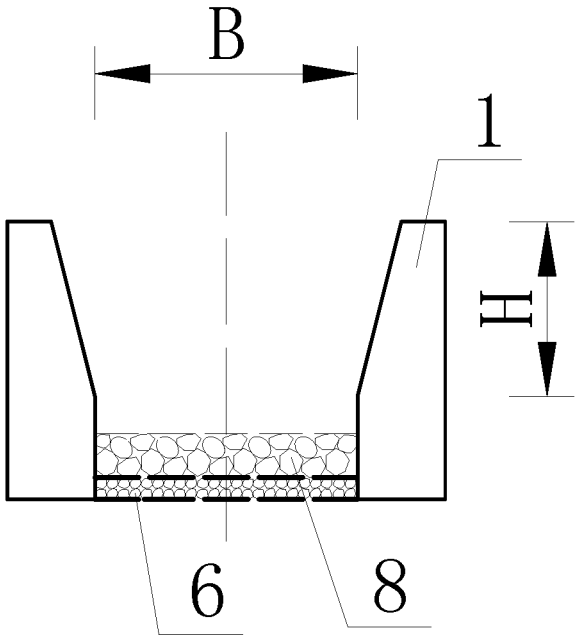
FIG. 5 is a diagrammatic drawing of the cross section of the pool section of the debris flow drainage channel with a step pool structure.
Figure 6:
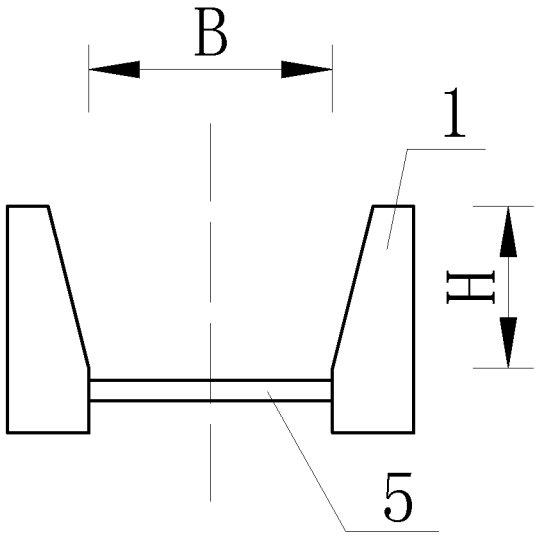
FIG. 6 is a diagrammatic drawing of the cross section of the step section of the debris flow drainage channel with a step pool structure.

As shown in FIG. 1, FIG. 2, FIG. 3, FIG. 4, FIG. 5 and FIG. 6, when the area of the drainage basin of some debris flow gully is 1.78 $km^2$, to prevent debris flow disasters, one silt arrester is designed to be placed in the middle of the drainage basin, and a drainage channel with a length of 240 m is designed to be built on a deposition fan. For the drainage channel, the average gully bed longitudinal slope $i_0$ of the channel bottom is 0.40, the flow rate of the drained debris flow is 96 $m^3/s$, and the density is 21.5 $kN/m^3$, to control the intense abrasion and scouring actions of the debris flow, the debris flow drainage channel with a step-pool structure is adopted. The debris flow drainage channel with a step pool structure consists of a drainage channel bottom and drainage channel side walls (1) arranged on both sides of the drainage channel bottom, wherein the drainage channel bottom consists of multiple fully lined step sections. Two sections are arranged at a given interval, and a pool section is filled between every adjacent upstream and downstream step sections (2). The step section (2) consists of an upper indented sill (3) located upstream, a lower indented sill (4) located downstream and a fully lined baseplate (5) connecting the upper indented sill (3) with the lower indented sill (4). The pool section consists of a cable net cage bottom protection (6), a cable net cage buffer layer (7) and block stones (8). The cable net cage buffer layer is arranged above the cable net cage bottom protection (6) and clung to the upper indented sill (3) of the downstream step section (2), and the block stones are arranged in a space defined by the side walls (1), the cable net cage bottom protection (6), the lower indented sill (4) of the upstream step section (2) and the cable net cage buffer layer (7). The cable net cage bottom protection (6) and the cable net cage buffer layer (7) are formed by wrapping block stones in a cable net; the top surface of the pool section is flush with the highest point of the downstream step section (2).

According to the given conditions (i.e., the flow rate of drained debris flow is 96 $m^3/s$, the average gully bed longitudinal slope $i_0$ of the channel bottom is 0.40, and the density is 21.5 $kN/m^3$) of the debris flow area, the width B of the drainage channel bottom being 8.0 m and the depth H of the drainage channel being 2.5 m are planned and designed.

A laying length $L_2$ of the block stones of 2.0 m, a laying thickness $h_{12}$ of the block stones (8) of 2.0 m, a thickness $L_3$ of the cable net cage buffer layer (7) of 1.0 m, and a particle size of block stones laid in the pool of 0.5 m are determined according to the density of the debris flow, and the length $L_4$ of the pool section is 3.0 m (i.e., $L_2+L_3$).

The fully lined baseplate (5), which has a thickness of 1.0 m, is composed of a reinforced concrete structure. The slope $i_1$ of the step section (2) is 0.15, determined according to the abrasion resistance of materials constituting the fully lined baseplate (5). The length $L_1$ of the step section (2) is designed mainly according to the average gully bed longitudinal slope $i_0$ and the materials constituting the fully lined baseplate (5) and is taken as 6.0 m, which satisfies the condition $L_1/4 \le L_4 \le L_1/2$. Thus, the suspension height $h_{11}$ of the lower indented sill (4) is 2.7 m, which is obtained using $(L_1+L_4)\times i_0-L_1\times i_1=(L_1+L_2+L_3)\times i_0-L_1\times i_1=(6.0+2.0+1.0)\times 0.40-6.0\times 0.15$.

According to the density of the debris flow and the suspension height $h_{11}$ of the lower indented sill (4), the thickness $h_{13}$ of the cable net cage bottom protection (6) is 1.0 m, the cable diameter of the cable net cage bottom protection (6) and the cable net cage buffer layer (7) is 0.01 m, and the mesh size of the cable net is 0.2 m×0.2 m. Finally, the extra-buried depth $h_{14}$ of the lower indented sill (4) is 1.0 m.

The height $h_1$ of the lower indented sill (4) is 6.7 m (i.e., $h_{11}+h_{12}+h_{13}+h_{14}=2.7+2.0+1.0+1.0$), and the height $h_2$ of the upper indented sill (3) is 3.0 m (i.e., $h_{12}+h_{13}=2.0+1.0$).

Summarizing, the key parameters of the debris flow drainage channel with a step pool structure are as follows: the average gully bed longitudinal slope $i_0$ of the channel bottom is 0.40, the width B of the drainage channel bottom is 8.0 m, and the depth H of the drainage channel is 2.5 m. The slope $i_1$ of the step section (2) is 0.15, the length $L_1$ of the step section (2) is 6.0 m, $h_2$ of the upper indented sill (3) is 3.0 m, and the height $h_1$ of the lower indented sill (4) is 6.7 m. In addition, the fully lined baseplate (5) consists of a reinforced concrete structure, with a thickness of 1.0 m. For the pool section, the laying length $L_2$ of the block stones (8) is 2.0 m, the laying thickness $h_{12}$ of the block stones (8) is 2.0 m, the particle size of the block stones (8) is 0.5 m, the thickness $L_3$ of the cable net cage buffer layer (7) is 1.0 m, the height of the cable net cage buffer layer (7) is 2.0 m, the thickness $h_{13}$ of the cable net cage bottom protection (6) is 1.0 m, the length of the cable net cage bottom protection (6) is 3.0 m, the cable diameter of the cable net cage bottom protection (6) and of the cable net cage buffer layer (7) is 0.01 m, the mesh size of the cable net is 0.2 m*0.2 m, and the suspension height $h_{11}$ of the lower indented sill (4) is 2.7 m.

Embodiment 2

As shown in FIG. 1, FIG. 2, FIG. 3, FIG. 4, FIG. 5 and FIG. 6, when the area of the drainage basin of a given debris flow gully is 8.6 $km^2$, to prevent debris flow disasters, three silt arresters are designed to be arranged in the middle of the drainage basin, and a drainage channel with a length of 480 m is designed to be built on a deposition fan. For the drainage channel, the average gully bed longitudinal slope $i_0$ of the channel bottom is 0.20, the flow rate of the drained debris flow is 265 $m^3/s$, and the density is 15 $kN/m^3$, to control the intense abrasion and scouring actions of the debris flow, and the debris flow drainage channel with a step pool structure is adopted. The debris flow drainage channel with a step pool structure consists of a drainage channel bottom and drainage channel side walls (1) arranged on both sides of the drainage channel bottom, wherein the drainage channel bottom consists of multiple fully lined step sections (2) arranged at a given interval and a pool section filled between every adjacent upstream and downstream step sections (2). Each step section (2) consists of an upper indented sill (3) located upstream, a lower indented sill (4) located downstream, and a fully lined baseplate (5) connecting the upper indented sill (3) with the lower indented sill (4). The pool section consists of a cable net cage bottom protection (6), a cable net cage buffer layer (7) and block stones (8). The cable net cage buffer layer is arranged above the cable net cage bottom protection (6) and clung to the upper indented sill (3) of the downstream step section (2), and the block stones are arranged in a space defined by the side walls (1), the cable net cage bottom protection (6), the lower indented sill (4) of the upstream step section (2) and the cable net cage buffer layer (7). The cable net cage bottom protection (6) and the cable net cage buffer layer (7) are formed by wrapping block stones in a cable net. In addition, the top surface of the pool section is flush with the highest point of the downstream step section (2).

According to the given conditions (i.e., the flow rate of the drained debris flow is 265 $m^3/s$, the average gully bed longitudinal slope $i_0$ of the channel bottom is 0.20, and the density is 15 $kN/m^3$) of the debris flow area, a width B of the drainage channel bottom of 10.0 m and a depth H of the drainage channel of 5.0 m are planned and designed.

According to the density of the debris flow, the laying length $L_2$ of the block stones is 4.0 m, the laying thickness $h_{12}$ of the block stones (8) is 1.0 m, the thickness $L_3$ of the cable net cage buffer layer (7) is 0.5 m, and the particle size of the block stones laid in the pool is 0.2 m. In addition, the length $L_4$ of the pool section is 4.5 m (i.e., $L_2+L_3$).

The fully lined baseplate (5) is a cement-laid stone masonry structure, and the thickness is 0.5 m. The slope $i_1$ of the step section (2) is 0.08, as determined according to the abrasion resistance of materials composing the fully lined baseplate (5). The length $L_1$ of the step section (2) is planned mainly according to the average gully bed longitudinal slope $i_0$ and the materials of the fully lined baseplate (5), therein taking on a value of 18.0 m. The suspension height $h_{11}$ of the lower indented sill (4) is 3.06 m, calculated according to the formula $(L_1+L_4)\times i_0-L_1\times i_1=(L_1+L_2+L_3)\times i_0-L_1\times i_1=(18.0+4.0+0.5)\times 0.20-18.0\times 0.08$. Because $h_{11}$ is greater than 0.3 m, $h_{11}$ does not satisfy the given conditions. The length $L_1$ of the step section (2) is 16.0 m, which satisfies the formula of $L_1/4\leq L_4\leq L_1/2$, and the suspension height $h_{11}$ of the lower indented sill (4) is 2.82 m, obtained using the formula $(L_1+L_4)\times i_0-L_1\times i_1=(L_1+L_2+L_3)\times i_0-L_1\times i_1=(16.0+4.0+0.5)\times 0.20-16.0\times 0.08$.

Based on the density of the debris flow and the suspension height $h_{11}$ of the lower indented sill (4), the thickness $h_{13}$ of the cable net cage bottom protection (6) is 0.5 m, the cable diameter of the cable net cage bottom protection (6) and the cable net cage buffer layer (7) is 0.005 m, and the mesh size of the cable net is 0.1 m*0.1 m. In addition, the extra-buried depth $h_{14}$ of the lower indented sill (4) is 0.5 m.

The height $h_1$ of the lower indented sill (4) is 4.82 m (i.e., $h_{11}+h_{12}+h_{13}+h_{14}=2.82+1.0+0.5+0.5$), and the height $h_2$ of the upper indented sill (3) is 1.5 m (i.e., $h_{12}+h_{13}=1.0+0.5$).

Summarizing, the key parameters of the debris flow drainage channel with a step pool structure are as follows: the average gully bed longitudinal slope $i_0$ of the channel bottom is 0.20, the width B of the drainage channel bottom is 10.0 m, and the depth H of the drainage channel is 5.0 m. For the step section (2), the slope $i_1$ of the step section (2) is 0.08, the length $L_1$ of the step section (2) is 16.0 m, $h_2$ of the upper indented sill (3) is 1.5 m, and the height $h_1$ of the lower indented sill (4) is 4.82 m. The fully lined baseplate (5) is a cement-laid stone masonry structure with a thickness of 0.5 m. For the pool section, the laying length $L_2$ of the block stones (8) is 4.0 m, the laying thickness $h_{12}$ of the block stones (8) is 1.0 m, and the particle size of the block stones (8) is 0.2 m. The thickness $L_3$ of the cable net cage buffer layer (7) is 0.5 m, the height of the cable net cage buffer layer (7) is 1.0 m, the thickness $h_{13}$ of the cable net cage bottom protection (6) is 0.5 m, the length of the cable net cage bottom protection (6) is 4.5 m, the cable diameter of the cable net cage bottom protection (6) and the cable net cage buffer layer (7) is 0.005 m, the mesh size of the cable net is 0.1 m*0.1 m, and the suspension height $h_{11}$ of the lower indented sill (4) is 2.82 m.

The invention claimed is:

1. A debris flow drainage channel comprising:

a drainage channel bottom and drainage channel side walls arranged on both sides of the drainage channel bottom, wherein the drainage channel bottom comprises:

at least one upstream step section and at least one downstream step section, wherein the at least one upstream step section and the at least one downstream section are fully lined and distanced from each other by a predetermined interval, and wherein each step section comprises an upper vertical wall located upstream, a lower vertical wall located downstream and a fully lined baseplate connecting the upper vertical wall and the lower vertical wall; and at least one pool section disposed between the at least one upstream step section and the at least one downstream step section, wherein the at least one pool section comprises:

a cable net cage bottom protection, a cable net cage buffer layer and block stones, wherein the cable net cage buffer layer is disposed above the cable net cage bottom protection and abuts the upper vertical wall of the at least one downstream step section; and wherein the block stones are disposed in a space defined by the drainage channel side walls, the cable net cage bottom protection, the lower vertical wall of the at least one upstream step section and the cable net cage buffer layer;

wherein the cable net cage bottom protection and the cable net cage buffer layer are formed by wrapping additional block stones in a cable net, wherein the at least one pool section has a top surface that is flush with the highest point of the at least one downstream step section, wherein the at least one upstream step section and the at least one downstream step section have a step section length, and the at least one pool section has a length that is smaller than the step section length, wherein the length of the at least one pool section is equal to the sum of a laying length of the block stones and a thickness of the cable net cage buffer layer, wherein a length of the cable net cage bottom protection is equal to the length of the at least one pool section, wherein a height of the upper vertical wall is equal to the sum of a laying thickness of the block stones and a thickness of the cable net cage bottom protection, wherein a height of the cable net cage buffer layer is equal to the laying thickness of the block stones, wherein the length of the at least one pool section is greater than or equal to a quarter of the step section length and less than or equal to half of the step section length, wherein a height of the lower vertical wall is equal to the sum of a suspension height of the lower vertical wall, the laying thickness of the block stones, the thickness of the cable net cage bottom protection and an extra-buried depth of the lower vertical wall, wherein the suspension height of the lower vertical wall is less than or equal to 3.0 m, wherein the suspension height ($h_{11}$) of the lower vertical wall is calculated based on the equation: $h_{11}=(L_1+L_4)\times i_0-L_1\times i_1$, wherein $L_1$ refers to the step section length; $L_4$ refers to the length of the at least one pool section; $i_0$ refers to an average gully bed longitudinal slope, which is set as 0.2-0.4; and $i_1$ refers to a slope of the at least one upstream step section and the at least one downstream step section, and wherein the extra-buried depth of the lower vertical wall is 0.5-1.0 m.

2. The debris flow drainage channel according to claim 1, wherein the laying length of the block stones is 2.0-4.0 m;

wherein the laying thickness of the block stones is 1.0-2.0 m; and wherein a particle size of the block stones is 0.2-0.5 m.

3. The debris flow drainage channel according to claim 1, wherein the thickness of the cable net cage bottom protection is 0.5-1.0 m;

wherein the thickness of the cable net cage buffer layer is 0.5-1.0 m;

wherein a mesh size of cable nets of the cable net cage bottom protection and the cable net cage buffer layer is set as (0.1 m×0.1 m)–(0.2 m×0.2 m); and wherein the cable diameter of the cable nets of the cable net cage bottom protection and the cable net cage buffer layer is 0.005-0.01 m.

4. The debris flow drainage channel according to claim 1, wherein the slope of the at least one upstream step section and the at least one downstream step section is 0.08-0.15, and the step section length is 5.0-20.0 m.

5. The debris flow drainage channel according to claim 1, wherein the baseplate comprises a cement-laid stone masonry structure, a concrete structure or a reinforced concrete structure;

wherein a thickness of the base plate is 0.5-1.0 m; and wherein the ratio between a width of the drainage channel bottom and a depth of the drainage channel is greater than or equal to 2.0.

6. The debris flow drainage channel according to claim 1, wherein the drainage channel is applicable to drain debris flows that have an average gully bed longitudinal slope of 0.2-0.4.

* * * * *